United States Patent [19]

Rothschild

[11] Patent Number: 4,737,320

[45] Date of Patent: Apr. 12, 1988

[54] CARBONATING HEAD

[76] Inventor: Bertram P. Rothschild, 175 Anderson Avenue, Northcliff 2195, Johannesburg, South Africa

[21] Appl. No.: 823,060

[22] Filed: Jan. 27, 1986

[30] Foreign Application Priority Data

Jan. 28, 1985 [ZA] South Africa ..... 85/0640

[51] Int. Cl.[4] ..... B01F 3/04

[52] U.S. Cl. ..... 261/64.3; 141/19; 141/330; 215/314

[58] Field of Search ..... 261/64 B; 141/19, 329, 141/330; 215/314

[56] References Cited

U.S. PATENT DOCUMENTS

| | | | |
|---|---|---|---|
| 662,499 | 11/1900 | Reenstierna | 141/19 |
| 2,205,938 | 6/1940 | Ward | 141/19 |
| 2,593,165 | 4/1952 | Metzger | 141/19 |
| 2,702,600 | 2/1955 | Allen | 141/19 |
| 2,717,720 | 9/1955 | Nissen | 141/19 |
| 2,857,901 | 10/1958 | Neely | 141/330 |
| 2,921,711 | 1/1960 | Mack | 141/19 |
| 3,318,346 | 5/1967 | Maltner | 141/295 |
| 3,868,978 | 3/1975 | Knopf | 141/19 |
| 4,457,877 | 7/1984 | Love | 261/64 B |

FOREIGN PATENT DOCUMENTS

| | | | |
|---|---|---|---|
| 854618 | 6/1952 | Fed. Rep. of Germany | 215/314 |

*Primary Examiner*—Tim Miles

*Attorney, Agent, or Firm*—Donald A. Kaul

[57] ABSTRACT

A carbonating head is provided with an internal passage, having a non-return valve therein, leading to a threaded socket. The socket can be screwed onto a plastic bottle so that pressurized gas in the passage can be used to carbonate liquid in the bottle.

5 Claims, 1 Drawing Sheet

CARBONATING HEAD

Figure 2:
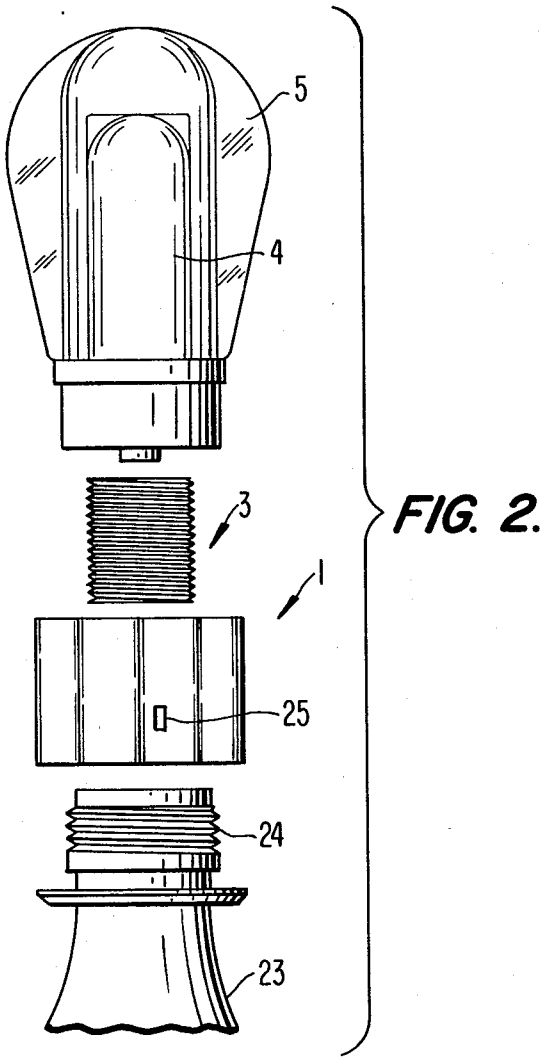

This invention relates to a carbonating head for domestic use.

One form of conventional domestic carbonating apparatus comprises a carbonating head which screws onto a vessel. In use the vessel is filled with water to an indicated level and a cylinder containing pressurized $CO_2$ is applied to the head to permit release of the $CO_2$ into the vessel. Carbonated water, or soda water as it is commonly called, is released from the apparatus for consumption through a spout by operating a lever on the carbonating head.

Apparatus of this kind is well known and widely used. It does, however, suffer from the disadvantage that the quantity of soda water made available for immediate consumption is limited to the size of the vessel of the apparatus. In other words, once the contents of the vessel have been exhausted, the carbonating process has to be repeated before fresh soda water is available for consumption. This is obviously not ideal when large quantities of soda water may be required, for example at social functions.

It is accordingly an object of this invention to provide apparatus with which the above-mentioned disadvantage can be overcome.

A carbonating head according to the invention has a passage therethrough and connecting means for releasably connecting a pressurized gas cylinder thereto to introduce pressurized gas into the passage, characterized in that the passage leads into a socket, the socket having an internal screw thread conforming to and permitting the head to be screwed onto the thread surrounding the mouth of a blow moulded plastic bottle, thereby enabling such a bottle to serve as a vessel in which liquid can be carbonated.

The passage may be interrupted by a non-return valve permitting gas to flow only in a direction pressurizing the plastic bottle. In one form the non-return valve may be provided at one end of a tubular member provided in the head. In this form the non-return valve may comprise a hollow needle formed integrally with the tubular member, the needle being surrounded by a sleeve of flexible material.

The tubular member at its end remote from the non-return valve may carry a pin arranged to pierce or open the pressurized gas cylinder when the latter is operatively connected to the carbonating head. The pin may be provided on an insert mounted in the tubular member.

The tubular member referred to above is preferably located within a spigot provided on the carbonating head, the spigot having an exterior screw thread and providing the connecting means for connecting the pressurized gas cylinder to the body. The outermost ends of the tubular member and the sleeve may define between them a channel housing an O-ring adapted to seal the connection between the carbonating head and the pressurized gas cylinder when the latter is operatively connected to the carbonating head.

In one form of the invention the socket of the carbonating head may be formed in a member moulded onto the assembly of the tubular member and the spigot. A rubber or plastic sealing ring may be provided in the base of the socket to seal the connection between the carbonating head and the plastic bottle when the head is operatively connected thereto.

In a preferred form of the invention the socket of the carbonating head is defined by an annular wall and an aperture is provided in the wall, the aperture serving as a pressure relief passage for escape of gas when the carbonating head is unscrewed from the plastic bottle or if the carbonating head is applied with insufficient torque to the plastic bottle.

Figure 1:
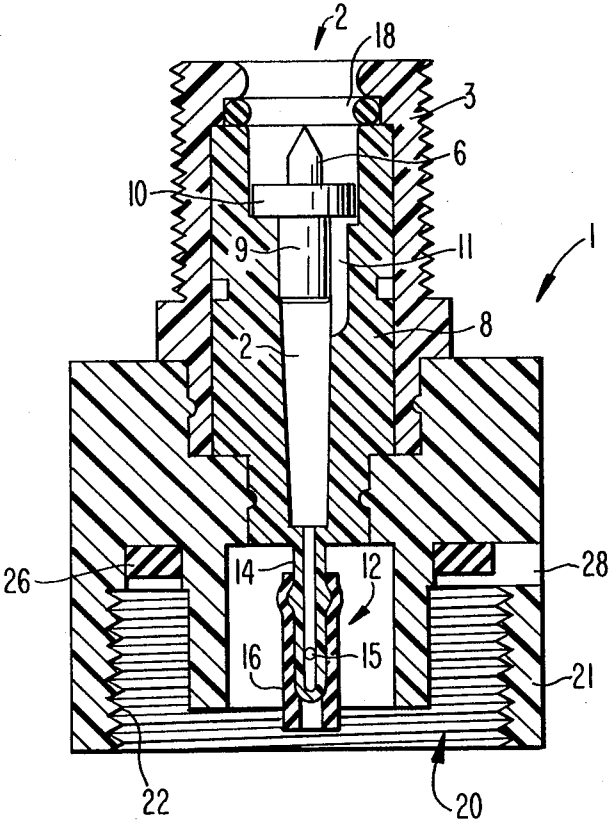

A preferred embodiment of the invention will now be described by way of example with reference to the accompanying drawings in which;

FIG. 1 is a cross-sectional elevation of a carbonating head according to the invention; and FIG. 2 illustrates the use of the head.

A carbonating head 1 comprises a generally cylindrical body having a passage 2 therethrough. At its upper end the head 1 has a threaded spigot 3 which provides connecting means for releasably connecting a pressurized $CO_2$ cylinder 4 to the carbonating head. This is achieved in conventional manner by means of a conventional holder 5 into which the cylinder 4 containing pressurized $CO_2$ is introduced. When the holder 5 is screwed onto the spigot 3, the seal (or valve) of the cylinder 4 is broken and $CO_2$ is released into the passage 2. In this embodiment of the invention, the seal (or valve) of the cylinder 4 is broken by a pin 6 mounted in a tubular member 8 located in the spigot 3. The tubular member 8 defines in part the passage 2 through the carbonating head. Conveniently the pin 6 forms part of an insert 9 mounted in the passage 2. At its upper end the insert 9 has an enlarged collar 10 preventing downstream displacement of the insert along the passage 2. In order to permit the flow of $CO_2$ past the insert 9, a recess 11 is formed in the wall of the tubular member 8.

At the end of the tubular member 8 remote from the insert 9, a non-return valve 12 is provided which interrupts the passage 2 through the carbonating head. The non-return valve 9 serves the normal function of preventing release of gas through the head 1 in an upstream direction. The non-return valve 12 comprises a hollow needle 14 formed integrally with the tubular member 8 and having a lateral opening 15 therein. The needle 14 is surrounded by a sleeve of flexible material 16.

The uppermost ends of the spigot 3 and the tubular member 8 define between them a channel which houses a rubber O-ring 18. The O-ring 18 is adapted to seal the connection between the carbonating head 1 and the pressurized $CO_2$ cylinder 4 when the latter is operatively connected to the carbonating head.

At its end remote from the spigot 3 the carbonating head has a socket 20 defined by annular wall 21, the arrangement being such that the passage 2 in the carbonating head leads through the non-return valve 12 into the socket 20. The wall 21 defining the socket 20 has an internal screw thread 22 which conforms to and permits the head to be screwed onto the thread 24 (also known as the finish) surrounding the mouth of a blow moulded plastic bottle 23 (FIG. 2). Such a bottle is generally referred to as a PET bottle. A rubber or plastic seal 26 is housed in the base of the socket 20 to ensure sealing contact between the head and the plastic bottle.

In use, the head 1 can be used to carbonate as many bottles 25 as may be required. In the case of a 2 liter bottle, it is filled with ice cold water to a level of approximately 1,7 liters. The head 1 is screwed onto the bottle which is turned upside down. The holder 5 with a cylinder 4 is applied to the spigot 3 of the head and rotated until $CO_2$ bubbles through the water. The bottle is continuously and vigorously shaken whilst the $CO_2$ is released into it to ensure that a maximum amount of $CO_2$ is dissolved into the water. In the case of a standard 8 g cylinder 4 under a pressure of say 60 bar, two such cylinders can be exhausted (without removing the head 1 inbetween) to provide a high grade soda water.

Once the two cylinders have been exhausted, the head 1 is removed and a conventional screw closure is applied to the bottle 23 to prevent its contents from losing its carbonation. Any number of bottles 23 may thus be carbonated in advance of, for example, a social function.

As a safety precaution, an aperture 28 in the wall 21 defining the socket 20 serves as a pressure relief passage for escape of gas when the carbonating head 1 is unscrewed from the bottle 23 and thus prevents the carbonating head from becoming a projectile under the pressure of gas in the bottle 23. The aperture 28 also allows escape of gas if the carbonating head 1 is applied with insufficient torque to the bottle 23. This will become apparent to a user, who will be alerted to apply increased torque to the carbonating head.

Many other embodiments of the invention may be made differing in matters of detail only from that described above and without departing from the scope of the invention as defined in the appended claims.

What is claimed is:

1. A carbonating head adapted to be connected to a pressurized gas cylinder removably disposed within a gas cylinder holder, said carbonating head comprising:

a body having a passage therethrough;

a spigot on said body having an exterior screw thread for connecting said gas cylinder holder to said body to enable pressurized gas from said cylinder to enter said passage;

said body having a socket which connects with said passage;

said socket having an internal screw thread for connecting said body to a plastic bottle having liquid therein which is desired to be pressurized;

said socket being defined by an annular wall;

said internal screw thread extending at least partially along the interior of said annular wall;

said annular wall having a pressure relief aperture extending therethrough;

a sealing ring disposed within said socket and adapted to bear against the top of the plastic bottle;

pin means disposed within said spigot to open said pressurized gas cylinder as said cylinder holder is screwed onto said exterior screw threads of said spigot; thereby permitting pressurized gas to flow through said passage and into the liquid in said plastic bottle; and non-return valve means disposed within said body along said passage to permit pressurized gas to flow only in the direction from said gas cylinder toward said plastic bottle;

said pressure relief aperture being operative to permit gas to discharge from within said body when said body is unscrewed from the plastic bottle after pressurization of the liquid within the plastic bottle has been completed.

2. A carbonating head as defined in claim 1 wherein said body includes a tubular member which defines said passage and wherein said pin means includes an insert disposed within said passage, said insert having a pointed end directed toward said pressurized gas cylinder, and a collar surrounding said insert to prevent displacement thereof along a recess portion communicating with said passage to permit the flow of pressurized gas past said insert.

3. A carbonating head as defined in claim 1 wherein said body includes a tubular member which defines said passage, said tubular member being disposed within said spigot, a channel means formed between the end of said tubular member and the end of said spigot, and an O-ring seal disposed within said channel means to seal the connection between said body and the pressurized gas cylinder when the gas cylinder is operationally connected to the body.

4. A carbonating head as defined in claim 1 wherein said body includes a tubular member which defines said passage and wherein said tubular member is disposed within and assembled with said spigot.

5. In the combination of a plastic bottle containing liquid to be pressurized, a gas cylinder containing pressurized gas, a gas cylinder holder, and a pressurization head for connecting said cylinder and holder to said bottle to enable pressurized gas from said cylinder to enter said bottle and pressurize the liquid therein, the improvement in said pressurization head which comprises:

a body having a portion forming a spigot directed toward said cylinder and holder and a portion forming a socket directed toward said bottle;

said body further including an internal tubular member disposed partially within said spigot and partially within said socket;

said tubular member circumscribing and defining a gas flow passage through said body;

said spigot having an opening at the end thereof in communication with said passage;

said spigot having external screw threads thereon to enable said holder for said gas cylinder to be threadably connected to said head;

said spigot and said tubular member forming a channel means between the end of said tubular member the spigot opening;

an O-ring sealingly disposed within said channel means to assure that all pressurized gas from said cylinder will pass through said opening and into said passage;

pin means disposed within said tubular member, said pin means including a collar portion surrounding said insert portion and abutting against said tubular member to prevent displacement of said pin means along said passage, and a pointed end portion directed toward said gas cylinder and adapted to puncture a seal at the end of the gas cylinder when the cylinder holder is threaded onto said spigot;

said spigot including an annular wall which circumscribes and defines an opening which receives the end of the plastic bottle;

said annular wall being internally threaded to enable said head to be threadably connected to screw threads on the neck of the plastic bottle;

said tubular member including a recess portion along said passage at the location said insert portion is disposed to enable the pressurized gas from said cylinder to flow past said pin means and to continue through said gas flow passage toward said plastic bottle;

a sealing collar disposed within said socket adjacent the inner end of the annular wall to seal against the top of the plastic bottle when it is threaded into the socket to assure that pressurized gas does not escape;

said annular wall having a pressure relief aperture formed therein to permit the escape of excess gas as the plastic bottle is disconnected from the head after completion of pressurization of the liquid within the bottle; and non return valve means disposed within said socket along said gas flow passage to permit pressurized gas to flow only in the direction from the gas cylinder toward the plastic bottle.

* * * * *